United States Patent [19]

Billner

[11] Patent Number: 4,697,410

[45] Date of Patent: Oct. 6, 1987

[54] OPEN-END SPINNING DEVICE

[75] Inventor: Werner Billner, Ingolstadt, Fed. Rep. of Germany

[73] Assignee: Schubert & Salzer, Ingolstadt, Fed. Rep. of Germany

[21] Appl. No.: 861,558

[22] PCT Filed: Nov. 11, 1985

[86] PCT No.: PCT/DE85/00447

§ 371 Date: Jun. 30, 1986

§ 102(e) Date: Jun. 30, 1986

[87] PCT Pub. No.: WO86/02955

PCT Pub. Date: May 22, 1986

[30] Foreign Application Priority Data

Nov. 13, 1984 [DE] Fed. Rep. of Germany ..... 3441493

[51] Int. Cl.[4] ..... D01H 7/885

[52] U.S. Cl. ..... 57/401

[58] Field of Search ..... 57/401

[56] References Cited

U.S. PATENT DOCUMENTS 4,380,892 4/1983 Parker et al. ..... 57/401
4,483,136 11/1984 Stahlecker ..... 57/401
4,539,807 9/1985 Stahlecker ..... 57/401
4,543,779 10/1985 Wassenhoven ..... 57/401
4,557,105 12/1985 Brockmanns et al. ..... 57/401
4,601,166 7/1986 Roasch ..... 57/401

FOREIGN PATENT DOCUMENTS 62404 10/1982 European Pat. Off. .
2252424 6/1975 France .
2138848 10/1984 United Kingdom .

*Primary Examiner*—Donald Watkins
*Attorney, Agent, or Firm*—Dority & Manning

[57] ABSTRACT

The invention concerns an open-end spinning device with two friction rollers driven in the same direction and forming a spinning nip of which the roller rotating towards the spinning nip is a suction roller and in which the fibers fed into the spinning nip are twisted together into a thread in a yarn forming zone. At least one of the friction rollers (1, 2) is provided with a sector (I) subjected to negative air pressure in the spinning nip, in the range of the yarn forming zone (G). The width of said sector (I) extends, in the peripheral sense, from the yarn forming zone (G) to beyond the plane (A) connecting the axes of the friction rollers (1, 2) towards the side opposite to the spinning nip (3).

15 Claims, 2 Drawing Figures

OPEN-END SPINNING DEVICE

BACKGROUND AND SUMMARY OF THE INVENTION

The invention concerns an open-end spinning device with two friction rollers driven in the same direction and forming a spinning nip, of which the friction roller rotating towards the spinning nip is a suction roller, whereby the fibers fed into the spinning nip are twisted together into a thread in a yarn-forming zone.

In such a spinning device the friction rollers are provided with sectors subjected to negative air pressure so that the fibers are caused to fly into the nip area (DE-PS-No. 24,49,583). It also suffices if only one of the friction rollers is subjected to negative air pressure (EP-OS No. 00,62,404). In order to facilitate the flight of the fibers these sectors are large, in relation to the friction rollers' periphery, and are located on the side of the spinning nip, in the peripheral sense. Because of the size of the suction sectors air consumption is high in these devices. It has furthermore been shown that in such spinning devices the quality of the yarn deteriorates considerably at high spinning speeds.

It is the objective of the present invention to avoid the disadvantages and to create a device making it possible to spin a yarn of good quality, even at high spinning speeds.

This objective is attained in a device according to the introductory clause of claim 1 of the invention by providing at least one sector subjected to negative air pressure in the range of the yarn forming zone, in the spinning nip, whereby the width of said sector extends, in the peripheral sense, from the yarn forming zone to beyond the plane connecting the axes of the friction rollers towards the side opposite to the spinning nip. It was also shown that such as arrangement or the suction zone has a very beneficial influence upon the imparting or torsion to the yarn.

The sector subjected to negative air pressure can be very narrow, with a width from 4 to 8 mm and preferrably 6 mm wide, so that air consumption is extremely low. The middle of the sector subjected to negative air pressure is located within the plane connecting the axes above the friction rollers or at a distance of the axes-connecting plane, in the peripheral sense, on the side opposite to the spinning nip. Thus a suction zone of sufficient size for the required air flow rate is obtained, yet a concentration upon the yarn forming zone is achieved. It has been shown that the imparting of torsion to the yarn is greatly enhanced with such a design, even at high spinning speeds. Conveying of the fibers is enhanced if a sector of lesser negative air pressure procedes the sector of great negative air pressure on the friction roller rotating towards the spinning nip. Best results from the point of view of yarn strength are obtained if the middle of the sector subjected to suction air is spaced extends 1 mm from the plane connecting the friction rollers, on the side opposite to the spinning nip.

BRIEF DESCRIPTION OF THE DRAWINGS

An example of the invention is described below through the following drawings.

DESCRIPTION OF THE PREFERRED EMBODIMENT

Figure 1:
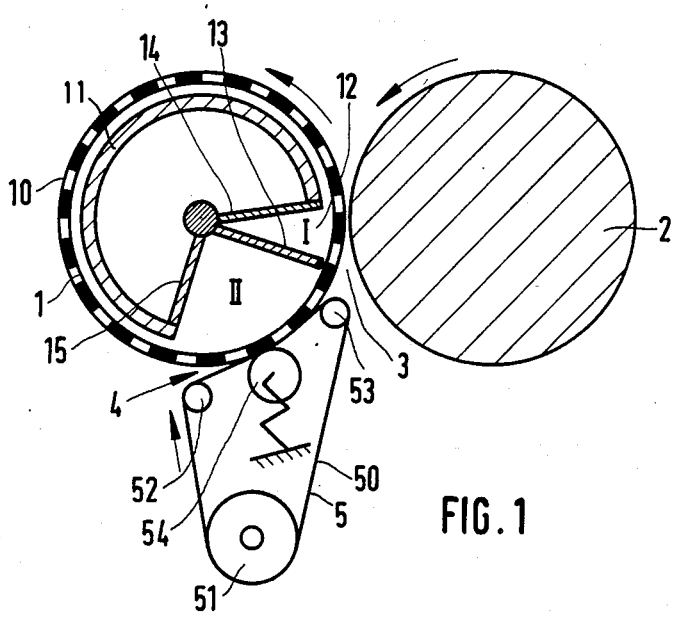
FIG. 1 shows a spinning device according to invention in cross-section.

FIG. 1 shows two friction rollers 1 and 2 located parallel to and in close proximity of each other. The friction rollers 1 and 2 form a spinning nip 3 in which the fed fibers are twisted into a yarn. To achieve this the frictions rollers 1 and 2 are driven in the same direction in a manner not shown here in further detail.

The friction roller 1, rotating towards the spinning nip 3, is equipped with a perforated casing surface 10 and with a connected suction insert 11. The suction insert 11 is provided with a slit 12 in the area of the spinning nip 3, extending in the longitudinal sense of the spinning nip 3, whereby the suction air stream is produced through said slit. The friction roller 2, rotating away from the spinning nip 3, is not perforated and is not subjected to suction air. The negative pressure zone of the friction roller 1 rotating towards the spinning nip 3 extends from a limit wall 15 up to the spinning nip 3 and ends there at a limit wall 14. The limit wall 15 is located before a collecting groove 4, in the rotational sense of the friction roller 1, to be described in greater detail hereinbelow.

Figure 2:
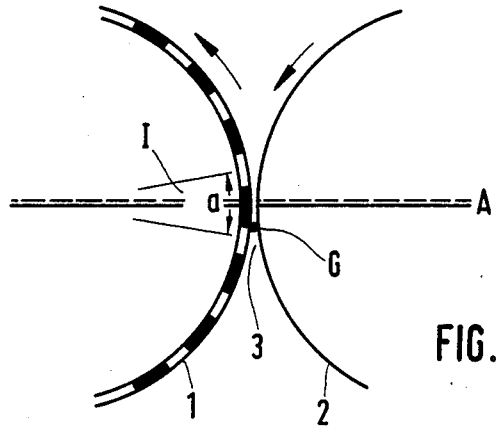
FIG. 2 shows the spinning nip area with a sector of greater negative air pressure.

The negative pressure zone of the friction roller 1 is subdivided by a separating wall 13 into two sectors I and II of different suction effect, whereby the sector I, forming the slit 12, is preferrably subjected to greater negative air pressure in the yarn forming zone. The negative air pressure in sector II merely ensures that the fibers are held securely on the friction roller 1 as they are conveyed into the spinning nip 3 and is kept suitably low. On the other hand, the negative pressure in sector I must be sufficiently great so that proper spinning is ensured. It has been found here that with an appropriately calculated negative air pressure in the yarn forming zone G it is possible to obtain especially good spinning results from the point of view of yarn strength if the sector I, forming the slit 12, is from 4 to 8 mm wide, in the peripheral sense, and preferrably 6 mm wide, and if it is spaced approximately 1 mm from the axes-connecting plane A of friction rollers 1 and 2 on the side opposite to the spining nip 3. Insofar as the friction roller 2 is also a suction roller, this also applies for the slit of said friction roller 2, across from sector I. In tests increased yarn strength was also obtained if, as FIG. 2 shows, the middle of sector I was located in the plane A connecting the friction rollers 1 and 2 or was located at approximately 1 mm from the axes-connecting plane A in the direction of the side opposite to spinning nip 3. This is indicated by the broken line in FIG. 2.

The collecting groove 4, mentioned earlier, in front of which the negative air pressure zone of sector II begins, is formed by the casing surface 10 of the friction roller 1, rotating towards the spinning nip, and by a moving guiding surface 50. This guiding surface 50 is the surface of an endles band 5 and reaches into the spinning nip 3. The endless band 5 is guided over deflection rollers 51, 52 and 53 and is pressed by at least one clamping roller 54 against the casing surface 10 of the friction roller 1, so that the guiding surface 50 is in contact with the friction roller 1 at the bottom of the collecting groove 4. The contact pressure of clamping roller 54 is increased by a spring, so that the band 5 is securely driven by friction roller 1, whereby the peripheral speed of the guiding surface 50 in the collecting groove 4 is synchronized with the pheripheral speed of friction roller 1.

The fiber material to be spun is fed in the conventional manner, in form of a fiber sliver, to an unravelling device (not shown) which separates it into single fibers. The single fibers are fed through a fiber channel (not shown), preferrably in the longitudinal sense of collecting groove 4 into said groove where they are collected and brought together into a fiber formation. The fiber formation, held fast by the suction air stream on the casing surface 10 of the friction roller 1 is given greater cohesion and forced guidance to the spinning nip 3 as it leaves the collecting groove 4 through the moving guiding surface 50, in contact with the casing surface 10. In this manner, a predoubled, even fiber formation arrives in the spinning nip 3 and the quality of the yarn is thereby improved.

I claim:

1. An open-end spinning device for spinning fibers, comprising two friction rollers driven in the same direction and forming a yarn forming zone and a spinning nip therebetween for receiving fibers wherein the friction roller rotating towards the spinning nip in the direction which the spinning nip receives fibers is a suction roller, whereby the fibers received by the spinning nip are twisted together into a yarn in a yarn forming zone, wherein at least one of the friction rollers is provided with a first sector subjected to negative air pressure in the spinning nip, in the range of the yarn forming zone, whereby the width of said first sector extends, in the peripheral sense, from the yarn forming zone to beyond a plane connecting the axes of the friction rollers towards the side opposite to the spinning nip, and further comprising a second sector of lesser negative pressure than said first sector on the suction roller preceding said first sector for conveying fibers into the yarn forming zone.

2. An open-end spinning device as defined in claim 1, wherein the width of the first sector measures from 4 to 8 mm.

3. An open-end spinning device as defined in claim 1, wherein the width of the first sector measures 6 mm.

4. An open-end spinning device as defined in claim 1 or 2, wherein the friction roller rotating towards the spinning nip is provided with the first sector and the first sector is provided with suction, while the friction roller rotating away from the spinning nip is not subjected to suction.

5. An open-end spinning device as defined in claim 1 or 2, wherein the middle of the first sector is located at a distance from the plane connecting the axes of the friction rollers in the peripheral sense, on the side opposite to the spinning nip.

6. An open-end spinning device as defined in claim 4, wherein the middle of the first sector is located at a distance from the plane connecting the axes of the friction rollers in the peripheral sense, on the side opposite to the spinning nip.

7. An open-end spinning device as defined in claim 1 or 2, wherein the first sector extends by approximately 1 mm, on the side opposite to the spinning nip, beyond the plane connecting the axes of the friction rollers.

8. An open-end spinning device as defined in claim 1, further comprising: a casing surface through which suction may be applied; a moving guide surface for moving fibers towards the spinning nip; and a collecting groove spaced from said spinning nip, said collecting groove being defined by said casing surface rotating in a direction for delivering fibers to the spinning nip and by said moving guide surface; said moving guide surface moving in said direction for delivering fibers to the spinning nip at a speed substantially equal to the surface speed of said casing surface.

9. An open-end spinning device for spinning fibers together into a thread, the open-end spinning device comprising:

two friction rollers for being driven in the same direction, said two friction rollers defining a spinning nip and a yarn forming zone therebetween for receiving and twisting the fibers into thread; at least one of said two friction rollers rotating in a direction for delivering the fibers to said spinning nip, said at least one of said two friction rollers having a casing surface through which suction may be applied; said at least one of said two friction rollers being for conveying the fibers received thereby on said casing surface thereof into said spinning nip;

a first suction section association with said at least one of said two friction rollers for providing suction in said spinning nip in the range of said yarn forming zone, said first suction sector extending peripherally about said casing surface from said yarn forming zone to said spinning nip; and a second suction sector of lesser suction than said first suction sector associated with said at least one of said two friction rollers for providing suction about said casing surface, said second suction sector preceding said first suction sector for conveying fibers into the yarn forming zone.

10. An open-end spinning device for spinning fibers together into a thread, the open-end spinning device comprising:

two friction rollers for being driven in the same direction, said two friction rollers defining a spinning nip and a yarn forming zone therebetween for receiving and twisting the fibers into threads; at least one of said two friction rollers rotating in a direction for delivering the fibers to said spinning nip, said at least one of said two friction rollers having a casing surface through which suction may be applied, said at least one of said two friction rollers being for conveying the fibers received thereby on said casing surface thereof into said spinning nip;

a first suction sector associated with said at least one of said two friction rollers for providing suction in said spinning nip in the range of said yarn forming zone, said first suction sector extending peripherally about said casing surface from said yarn forming zone to said spinning nip;

a second suction sector of lesser suction than said first suction sector associated with said at least one of said two friction rollers for providing suction about said casing surface, said second suction sector preceding said first suction sensor for conveying fibers into the yarn forming zone;

a moving guide surface for moving fibers towards said spinning nip; and a collecting groove spaced from said spinning nip, said collecting groove being defined by said casing surface rotating in said direction for delivering fibers to said spinning nip and by said moving guide surface; said moving guide surface moving in said direction for delivering fibers to said spinning notch at a speed substantially equal to the surface speed of said casing surface.

11. An open-end spinning device for spinning fibers, comprising two friction rollers driven in the same direction and forming a yarn forming zone and a spinning nip therebetween for receiving fibers, wherein at least one of said two friction rollers is provided with a first sector subjected to suction in said spinning nip, in the range of said yarn forming zone, the width of said first sector extending, in the peripheral sense, from said yarn forming zone through said spinning nip to beyond a plane connecting the axes of said two friction rollers, and wherein the middle of said first sector is located at a distance from said plane connecting the axes of said two friction rollers, in the peripheral sense, on the side of said plane opposite to said spinning nip.

12. An open-end spinning device as defined in claim 1, wherein the width of said first sector is between 4 and 8 mm.

13. An open-end spinning device as defined in claim 1, wherein the width of said first sector is 6 mm.

14. A open-end spinning device as defined in claim 1, wherein one of said two friction rollers rotates toward the spinning nip in the direction which the spinning nip receives fibers, said one of said two friction rollers being provided with said first sector.

15. An open-end spinning device as defined in claim 14, wherein a second sector of lesser suction than said first sector is provided said one of said two friction rollers, preceding said first sector, for conveying fibers into said yarn forming zone.

* * * * *